US007476166B2

(12) United States Patent
Yearick

(10) Patent No.: US 7,476,166 B2
(45) Date of Patent: Jan. 13, 2009

(54) KANGO GAME

(76) Inventor: David Yearick, 8 King Eider Way, Taylors, SC (U S) 29687

( * ) Notice: Subject to any disclaimer, the term of this patent is extended or adjusted under 35 U.S.C. 154(b) by 219 days.

(21) Appl. No.: 11/583,317

(22) Filed: Oct. 19, 2006

(65) Prior Publication Data

US 2008/0096699 A1 Apr. 24, 2008

(51) Int. Cl.
*A63B 65/12* (2006.01)
*A63B 59/02* (2006.01)

(52) U.S. Cl. ..... 473/505; D21/301; D21/305

(58) Field of Classification Search ..... 473/505, 473/513, 511; D22/106; D8/363; 43/11; 124/27, 5; 16/87.2; 273/412; D21/301, D21/305

See application file for complete search history.

(56) References Cited

U.S. PATENT DOCUMENTS 534,996 A * 3/1895 Cundy ..... 473/511
635,297 A * 10/1899 Caldwell ..... 411/411
1,921,523 A 8/1933 Hart
2,604,715 A * 7/1952 Brown, Jr. ..... 43/11
2,805,460 A * 9/1957 Gries ..... 24/698.1
4,657,253 A 4/1987 Lerner et al.
4,696,472 A 9/1987 Meyer
4,867,451 A 9/1989 Mitchell
5,174,580 A * 12/1992 Pratt ..... 473/513
5,224,703 A * 7/1993 Osher ..... 473/513
5,342,513 A * 8/1994 Wall et al. ..... 210/238
2008/0096699 A1 * 4/2008 Yearick ..... 473/505

* cited by examiner

*Primary Examiner*—Gene Kim
*Assistant Examiner*—M Chambers
(74) *Attorney, Agent, or Firm*—McNair Law Firm, P.A.

(57) ABSTRACT

The invention is a toy for performing a game of pitch and catch. The toy comprises a pair of rackets for propelling and catching a projectile. Each racket includes a rim for supporting a net between its inner periphery and a hook on its outer periphery. The projectile includes a generally circular member and an elastic band. The band is connected with the hook for propelling the projectile. The racket is positioned to catch the propelled projectile in the net.

12 Claims, 3 Drawing Sheets

KANGO GAME

BACKGROUND OF THE INVENTION

The invention is directed to a game of pitch and catch between at least a pair of players. The game is designed for use with younger children, generally between the ages of 10 and 20. However, younger or older persons may also find the game appealing.

In general, games of pitch and catch require a degree of skill and athletic ability to both cause the ball or projectile to be put into flight and to catch the projectile when in flight. The instant invention has as its primary object to assist and make easier the accomplishment of both of these functions while providing amusement for the players.

A primary object of the instant invention is the provision of means to assist in propelling a projectile.

Another object of the invention is the provision of means to assist in catching a projectile in flight.

Another object of the invention is the provision of light weight rackets and projectiles for performing pitch and catch.

Another object of the invention is a racket having a pocket and a projecting member.

Another object of the invention is a ball or projectile including a circular member connected with an elastic filament.

Another object of the invention is the provision of a game which is unique but easily understandable.

Another object of the invention is the provision of a game which is inexpensive to produce.

Another object of the invention is a game which promotes an increase in athletic skills.

SUMMARY OF THE INVENTION

The instant game of pitch and catch includes a pair of rackets for projecting and catching a projectile. The racket includes a generally oval or circular shaped rim to which a net is attached to extend within the inner periphery of the rim to form a pocket. A handle is secured with the rim to extend outwardly from its outer periphery. A hook is secured with the outer periphery of the rim in a position generally opposed the handle.

In use, the handle is adapted to be engaged by a player for moving the racket to catch the projectile in flight and to position the hook for engagement with the projectile for propelling it into flight.

The rim may be comprised wholly or partially of semi-rigid molded polymeric material. If only partially of molded polymeric material, the remaining rim portion is comprised of resilient tubing. The tubing may be formed of resilient polymeric material. A brace may be secured over a portion of the rim to include the tubing in a position generally opposite the handle. The brace is generally U-shaped to resiliently engage with the rim and that portion of the net engaged with the rim.

The hook may be carried by the brace or the tubing along an axis which extends generally parallel with the rim.

The projectile includes a body or ball and a resilient sling or elastic filament which is connected with the body. The body is generally round and formed of a resilient material or resilient filament. The sling comprises a resilient filament or elongated elastic member formed into a loop. In use, the loop is engaged with the hook, the body is drawn away from the hook causing the filament to be stretched. The body is released causing the filament to propel the projectile.

A game for pitch and catch including first and second rackets and a projectile. Each racket includes a generally circular rim connected with a generally linear handle and a net connected with said rim forming a pocket within the inner periphery of the rim. A hook is connected with the outer periphery of said rim generally opposite the handle. The projectile includes a generally circular mass or ball connected with an elongated loop of elastic material for propelling the projectile.

In use, players are in spaced positions and each carries a racket. The rackets are controlled to position the pocket to catch the projectile when in flight and to anchor the loop with the hook so that the projectile, when moved away from the hook, stretches the loop and when released allows the loop to recoil and propel the projectile into flight. The projectile is propelled and caught in repetitive back and forth motions between the players.

DESCRIPTION OF A PREFERRED EMBODIMENT

Figure 1:
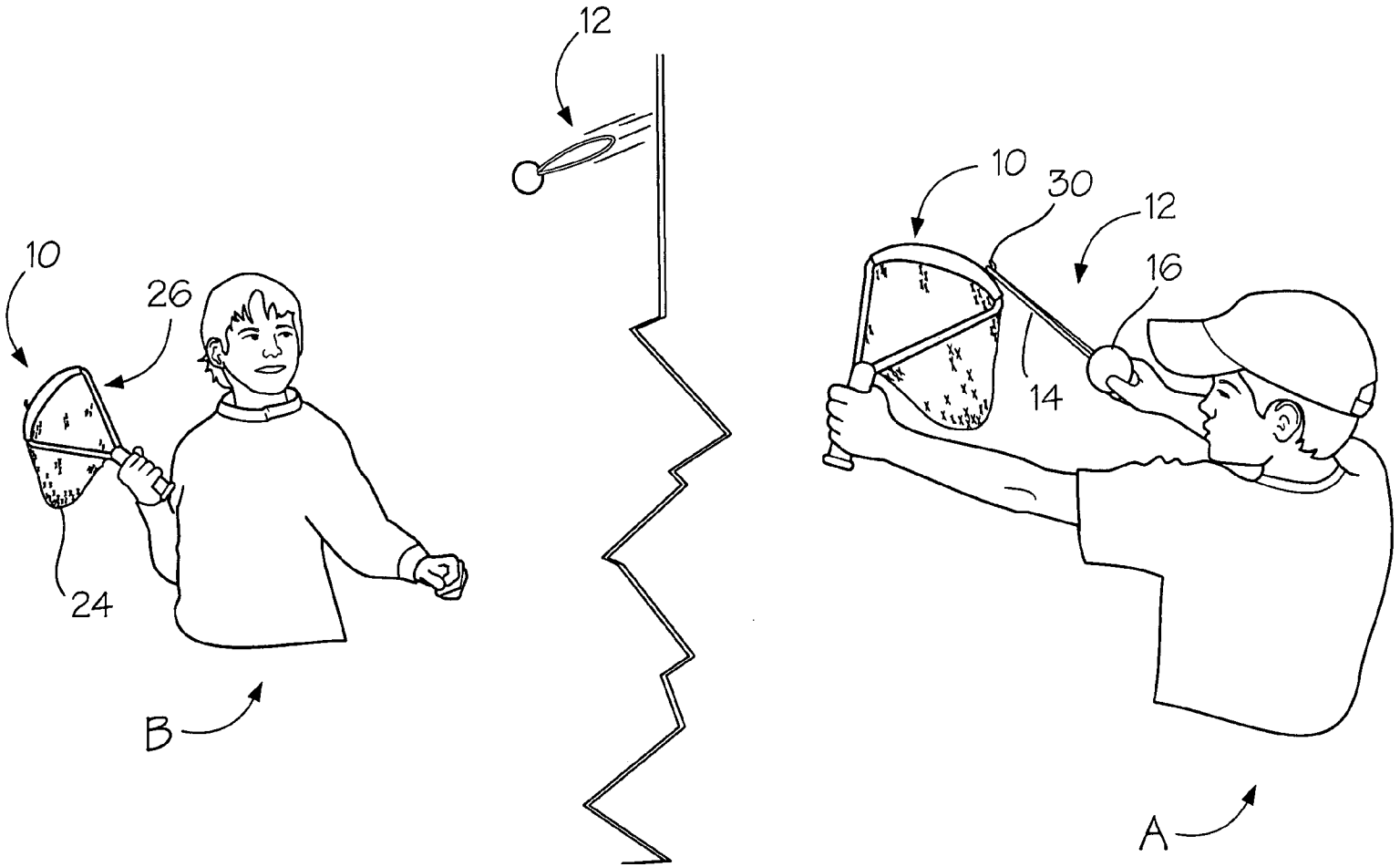
FIG. 1 is a schematic illustration of the pitch and catch game of the invention.
Figure 2:
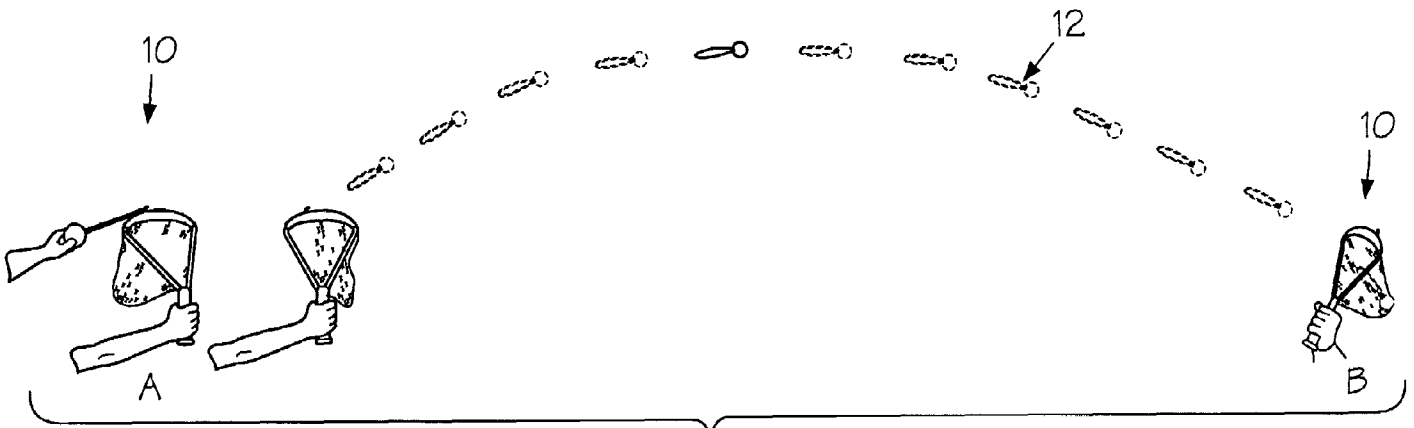
FIG. 2 is a schematic illustration of the manner in which the projectile is put into flight and caught.

Turning now to FIGS. 1 and 2 a general schematic of the instant game as played is provided. Generally, a pair of players A and B are shown. Each player is holding in one hand a racket 10. Player A is shown with racket 10 in a generally extended and elevated position with projectile 12 connected to and being drawn away from the racket. An elastic cord or filament 14, arranged in the form of a loop, is connected with mass or ball 16 and is shown in an extended position. This extended position is much like a slingshot in the drawn position with mass 16 being the propelled object.

Upon releases of mass 16, the stretched filament 14 retracts projecting the projectile toward player B. Player B also holds a racket 10 in an elevated position generally facing player A and projectile 12 which is now in flight and moving toward player B. When the projectile arrives, player B catches it in the net or webbing of the racket as illustrated in FIG. 2.

The process is repeated by player B with projectile 12 is propelled back toward player A.

The game is played with two or more players. When more than two players are involved, more than one projectile may or may not be used.

Figure 3C:
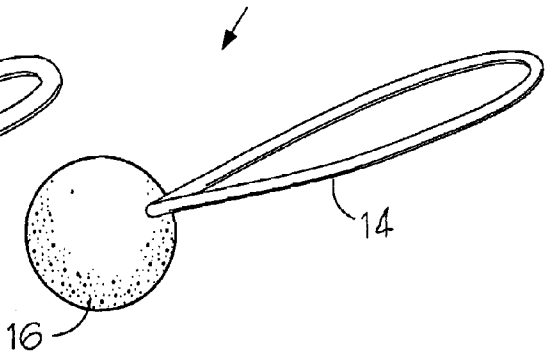
FIG. 3C is a perspective view of a third projectile or ball for use with the game.
Figure 3B:
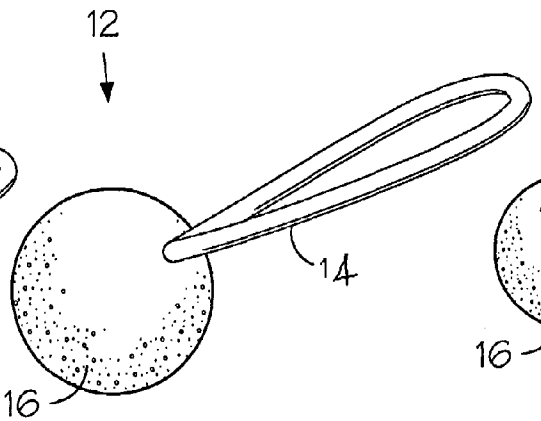
FIG. 3B is a perspective view of a second projectile or ball for use with the game.
Figure 3A:
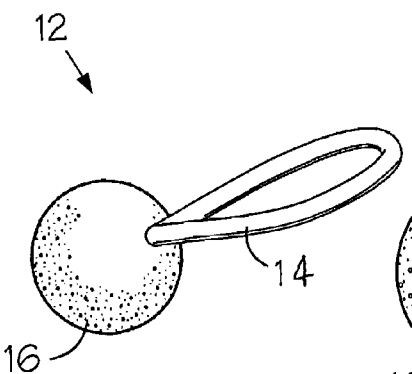
FIG. 3A is a perspective view of a first projectile or ball for use with the game.

Turning now to FIGS. 3A, B and C, projectile 12 comprises a generally circular mass or ball 16 which is connected with an elastic cord or filament 14. Ball 16 is preferably elastic and formed to a diameter of anywhere between 2" and 6". Ball 16 may be formed of rubber or an elastic, generally spongy polymer. It may be hollow or of an even consistency throughout.

Connected with ball 16 is a sling in the form of an elastic filament or cord 14 which is generally in the form of a loop. Cord 14 may comprise a single filament or a plurality of filaments provided sufficient elasticity is provided to allow the cord to be extended to substantially double its length and to contract with sufficient force to propel the ball between 5 yards, and 50 yards. The cord preferably is a filament formed of rubber or of a suitable polymer such as polyurethane or polyvinyl chloride. Other suitably elastic materials may be utilized.

Cord 14 is attached to ball 16 in any known manner just so long as it is secured in an unyielding manner. Cord 14 may range from between 4" to 18" in length and in diameter from ⅛" to ¼", depending upon the weight of the ball and the distance desired propelled.

Figure 4:
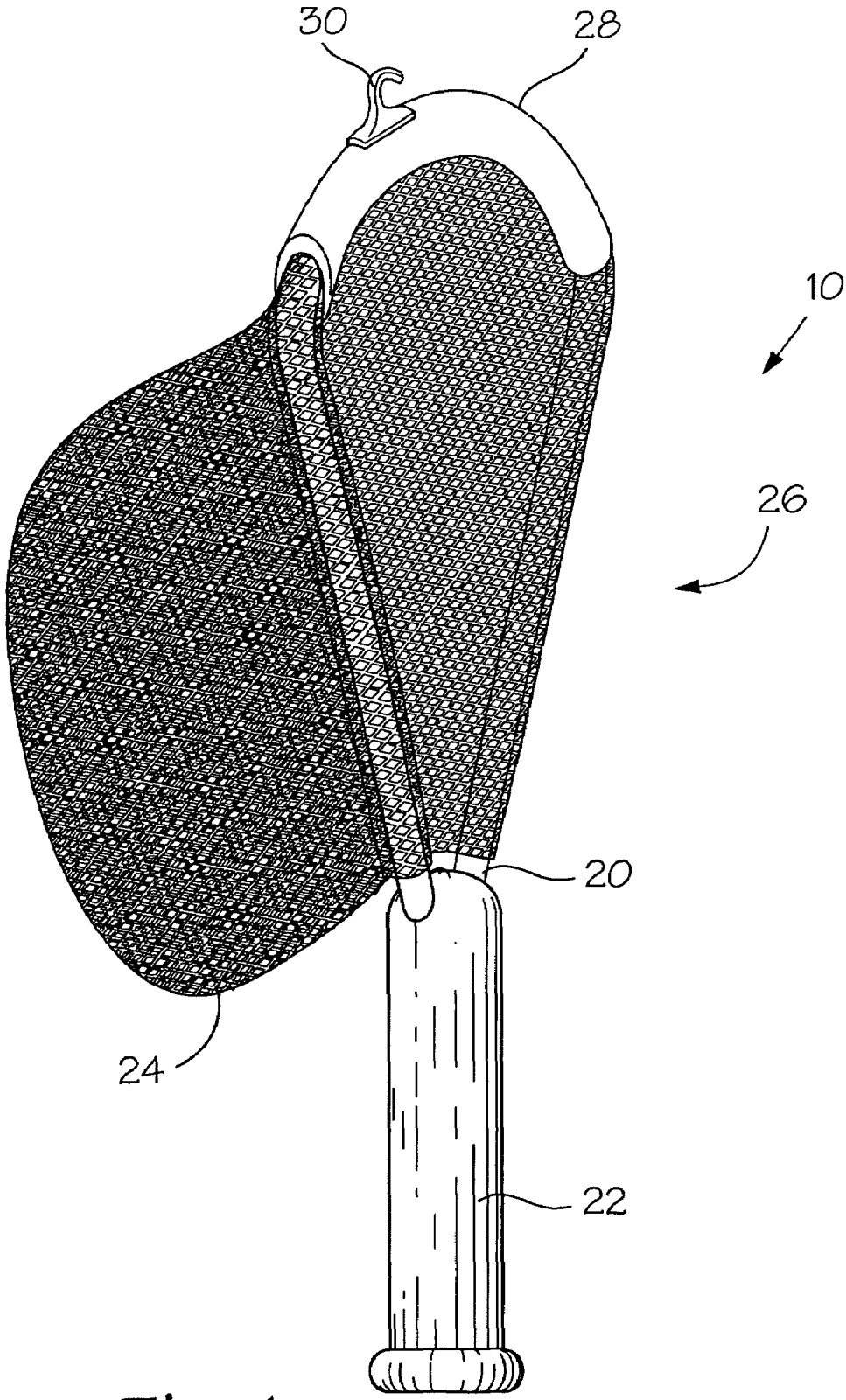
FIG. 4 is a perspective view of the racket for use with the game.

Turning now to FIG. 4, racket 10 is shown in detail. Racket 10 comprises rim 20 which is generally circular or an oval shape and which connects with handle 22 along its outer periphery. Handle 22 extends along an axis generally parallel with rim 20.

Net 24 is engaged about rim 20 and extends to one side thereof forming pocket 26 between the inner periphery of rim 20. The pocket is formed to be about 7" deep. The pocket size and depth may be altered as desired. It is noted that the net may be molded onto the rim or attached with fasteners as desired.

If desired, a generally U-shaped brace 28 is secured over a portion of the periphery of rim 20 and that portion of net 24 engaged with the rim. Brace 28 is applied to rim 20 generally opposite the position of handle 22. Brace 28 is formed of polymeric material which resiliently engages over rim 20. Brace 28 acts to stabilize the portion of the rim most distinct from the handle.

Secured to the outer surface of brace 28 is hook 30. Hook 30 is preferably C-shaped but it could be no more than a straight peg. The hook is generally arranged in any of several positions on the outer periphery of rim 20 generally opposite handle 22.

It is noted that the use of brace 28 is not necessary. When the brace is deemed to be unnecessary, hook 28 is connected with the outer periphery of rim 20 in generally the same position relative to handle 22.

Racket 10 is preferably molded of a generally semi-rigid polymeric material to comprise a generally circular or oval shaped rim with a handle extending from its outer edge. In this form, hook 30 may be formed with the rim in a selected position opposite the handle. In another arrangement, brace 28, carrying hook 30, may be secured over the rim 20 generally opposite the handle as earlier described. Alternatively, the racket may be comprised of a molded generally Y-shaped section with the molded portion of the rim in this arrangement forming a V. Tubing of synthetic material and of generally the same diameter is engaged over the outer ends of the V-shaped extensions to form a continuous rim which is generally circular or oval in shape. Another arrangement could have the entire racket formed of molded polymeric material. Brace 28 carrying hook 30 may be secured over the tubing as earlier described or hook 30 may simply be secured with the tubing or that portion of the rim opposite the handle.

In order to propel projectile 10, cord 14 is engaged over hook 30 with ball 16 being held by the player. The ball is drawn away from the hook causing cord 14 to be stretched into a desired stretched condition. The ball is released allowing the elongated cord to retract toward the hook propelling the ball in the direction in which the racket is pointed. The elastic strength and length of the cord may be varied as may the size and weight of the ball depending upon the desired results.

The game improves the dexterity and hand/eye coordination of the players while providing enjoyment, relaxation and fellowship.

While a preferred embodiment of the invention has been described using specific terms, such description is for illustrative purposes only, and it is to be understood that changes and variations may be made without departing from the spirit or scope of the following claims.

What is claimed is:

1. A projecting and catching game comprising;

a racket and a projectile; wherein said racket comprises a generally circular rim carrying a net, said net forming a pocket within the inner periphery of said rim; a handle secured with said rim and extending outwardly from its outer periphery; a hook secured with said rim in a position generally opposed said handle; wherein, said handle is adapted to be engaged by a player for moving said racket to catch said projectile in flight and to position said hook for engagement with said for propelling said projectile into flight and wherein said projectile includes a body connected with said sling, said sling comprising a resilient filament forming a loop which when engaged with said hook, anchors said loop so that said loop may be stretched to propel said projectile.

2. The device of claim 1 wherein said rim includes resilient tubing.

3. The device of claim 2 wherein said tubing is formed of resilient polymeric material.

4. The device of claim 1 wherein said rim is molded of polymeric material.

5. The device of claim 1 including a brace secured over a portion of said rim in a position generally opposite said handle.

6. The device of claim 5 wherein said hook is carried by said brace.

7. The device of claim 1 wherein said racket comprises a unitary unit molded of semi-rigid material.

8. The device of claim 1 wherein said handle is generally circular and formed along an axis.

9. A game for pitch and catch including first and second rackets and a projectile; wherein;

each said racket includes a generally circular rim connected with a generally linear handle, a net connected with said rim forming a pocket within the inner periphery of said rim and a hook connected with the outer periphery of said rim generally opposed said handle;

said projectile includes a generally circular mass connected with an elongated loop of elastic material for propelling said projectile; wherein, each player, in spaced positions, acts with repetitive actions to control a racket into positions to catch in said pocket said projectile when in flight, to grip said caught projectile, to secure said loop with said hook, to move said projectile away from said hook stretching said loop and to release said projectile allowing said loop to retract propelling said projectile into flight between said players.

10. The game of claim 9 wherein said circular mass is resilient and formed to have a diameter of between 1" and 2" .

11. The game of claim 9 wherein said loop is formed of a resilient polymeric filament of between 4" and 8" .

12. The game of claim 9 wherein said racket comprises a unitary molded member including said rim, handle and hook.

* * * * *